US010629360B2

(12) United States Patent
Shirouzu et al.

(10) Patent No.: US 10,629,360 B2
(45) Date of Patent: Apr. 21, 2020

(54) REACTOR HAVING IRON CORES AND COILS

(71) Applicant: FANUC CORPORATION, Minamitsuru-gun, Yamanashi (JP)

(72) Inventors: Masatomo Shirouzu, Yamanashi (JP); Kenichi Tsukada, Yamanashi (JP); Tomokazu Yoshida, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 2 days.

(21) Appl. No.: 16/018,661

(22) Filed: Jun. 26, 2018

(65) Prior Publication Data

US 2019/0013139 A1 Jan. 10, 2019

(30) Foreign Application Priority Data

Jul. 6, 2017 (JP) ..... 2017-132875

(51) Int. Cl.

| | |
|---|---|
| ***H01F 27/24*** | (2006.01) |
| ***H01F 27/28*** | (2006.01) |
| ***H01F 3/14*** | (2006.01) |
| ***H01F 37/00*** | (2006.01) |

(52) U.S. Cl.

CPC ..... *H01F 27/28* (2013.01); *H01F 3/14* (2013.01); *H01F 27/24* (2013.01); *H01F 37/00* (2013.01)

(58) Field of Classification Search

CPC ..... H01F 27/00–36

USPC ..... 336/65, 83, 170–173, 210–215, 233–234

See application file for complete search history.

(56) References Cited

U.S. PATENT DOCUMENTS

| | | | | |
|---|---|---|---|---|
| 10,008,322 | B2 * | 6/2018 | Bhide | H01F 37/00 |
| 2009/0261939 | A1 | 10/2009 | Shudarek | |
| 2017/0084377 | A1 | 3/2017 | Maeda et al. | |
| 2018/0040407 | A1 | 2/2018 | Yamamoto et al. | |

FOREIGN PATENT DOCUMENTS

| | | | | |
|---|---|---|---|---|
| CN | 103081045 | A | | 5/2013 |
| CN | 103578692 | A | | 2/2014 |
| DE | 102016010901 | A1 | | 3/2017 |
| JP | S60002815 | U | | 1/1985 |
| JP | 2005303229 | A | | 10/2005 |
| JP | 2013074084 | A | * | 4/2013 |
| JP | 2016152368 | A | | 8/2016 |
| JP | 2017-059805 | A | | 3/2017 |
| KR | 20110061935 | A | | 6/2011 |

* cited by examiner

*Primary Examiner* — Tuyen T Nguyen
(74) *Attorney, Agent, or Firm* — RatnerPrestia

(57) ABSTRACT

A reactor includes an outer peripheral iron core and at least three iron core coils arranged inside the outer peripheral iron core. Gaps, which can be magnetically coupled, are formed between at least three adjacent iron cores. Coils are arranged in coil spaces formed between the iron cores and the outer peripheral iron core. At least one corner part in the cross-section of the coil spaces in the axial direction is rounded, or the at least one corner part is one part of a polygon having an internal obtuse angle of not less than 100°.

5 Claims, 11 Drawing Sheets

REACTOR HAVING IRON CORES AND COILS

CROSS-REFERENCE TO RELATED APPLICATION

This application is a new U.S. Patent Application that claims benefit of Japanese Patent Application No. 2017-132875, filed Jul. 6, 2017, the disclosure of this application is being incorporated herein by reference in its entirety for all purposes.

BACKGROUND OF THE INVENTION

1. Field of the Invention

The present invention relates to a reactor having iron cores and coils.

2. Description of Related Art

Reactors include a plurality of iron core coils, and each iron core coil includes an iron core and a coil wound onto the iron core. Predetermined gaps are formed between the plurality of iron cores. Further, in recent years, there are also reactors in which a plurality of iron cores and coils wound onto the iron cores are arranged inside an annular outer peripheral iron core. Refer to, for example, Japanese Unexamined Patent Publication (Kokai) No. 2017-059805.

SUMMARY OF THE INVENTION

In such reactors, the coils are arranged in coil spaces formed between the outer peripheral iron core and the iron cores. The coil spaces may be at least partially rectangular in the axial cross-section of the reactor.

However, when the main magnetic flux flowing through the coils during energization of the reactor flows through the outer peripheral iron core, the magnetic flux concentrates at the corner parts of the rectangular coil spaces, bringing about a problem in that the magnetic flux increases locally. In such a case, iron loss increases and magnetic flux saturation tends to occur. Further, as the frequency increases, iron loss increases.

Thus, a reactor in which magnetic flux concentration at the corner parts of the coil spaces can be prevented is desired.

According to the first aspect, there is provided a reactor comprising an outer peripheral iron core and at least three iron core coils arranged inside the outer peripheral iron core, wherein the at least three iron core coils are composed of iron cores and coils wound onto the iron cores, respectively, gaps, which can be magnetically coupled, are formed between one of the at least three iron cores and another iron core adjacent thereto, the coils are arranged in coil spaces formed between the iron cores and the outer peripheral iron core, and at least one corner part in the cross-section of the coil spaces in the axial direction is rounded, or the at least one corner part is one part of a polygon having an interior obtuse angle of not less than 100°.

In the first aspect, since the corner parts of the coil spaces are rounded or the corner parts are defined by a part of a polygon having an obtuse angle, the concentration of magnetic flux at the corner parts can be mitigated, and as a result, iron loss can be reduced and magnetic flux saturation can be suppressed.

The object, features, and advantages of the present invention, as well as other objects, features and advantages, will be further clarified by the detailed description of the representative embodiments of the present invention shown in the accompanying drawings.

DETAILED DESCRIPTION

Figure 1A:
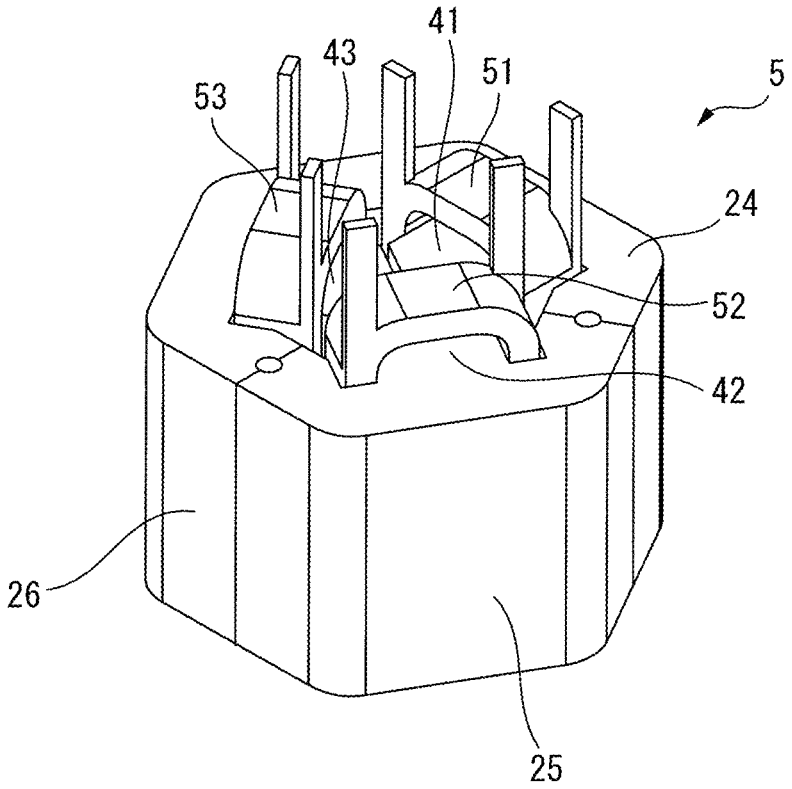
FIG. 1A is a perspective view of a reactor according to a first embodiment.

The embodiments of the present invention will be described below with reference to the accompanying drawings. In the following drawings, the same components are given the same reference numerals. For ease of understanding, the scales of the drawings have been appropriately modified.

In the following description, a three-phase reactor will mainly be described as an example. However, the present disclosure is not limited in application to a three-phase reactor but can be broadly applied to any multiphase reactor requiring constant inductance in each phase. Further, the reactor according to the present disclosure is not limited to those provided on the primary side or secondary side of the inverters of industrial robots or machine tools but can be applied to various machines.

Figure 1B:
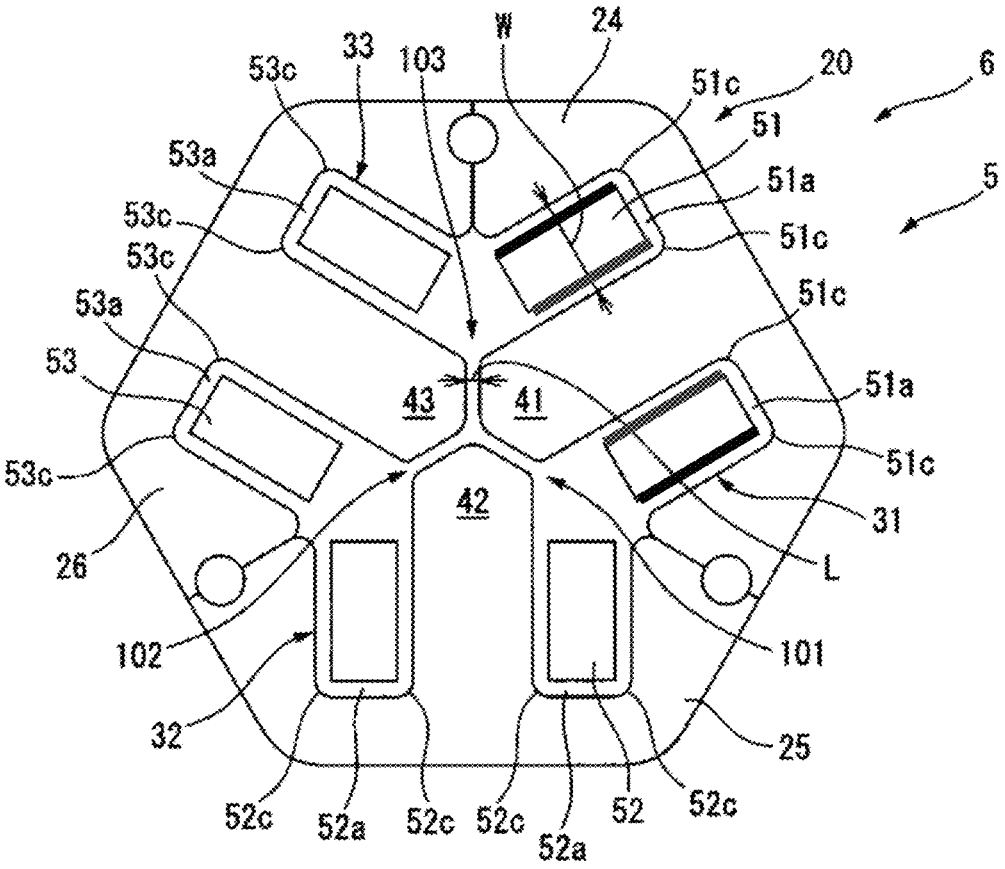
FIG. 1B is a cross-sectional view of the reactor according to the first embodiment.
Figure 1C:
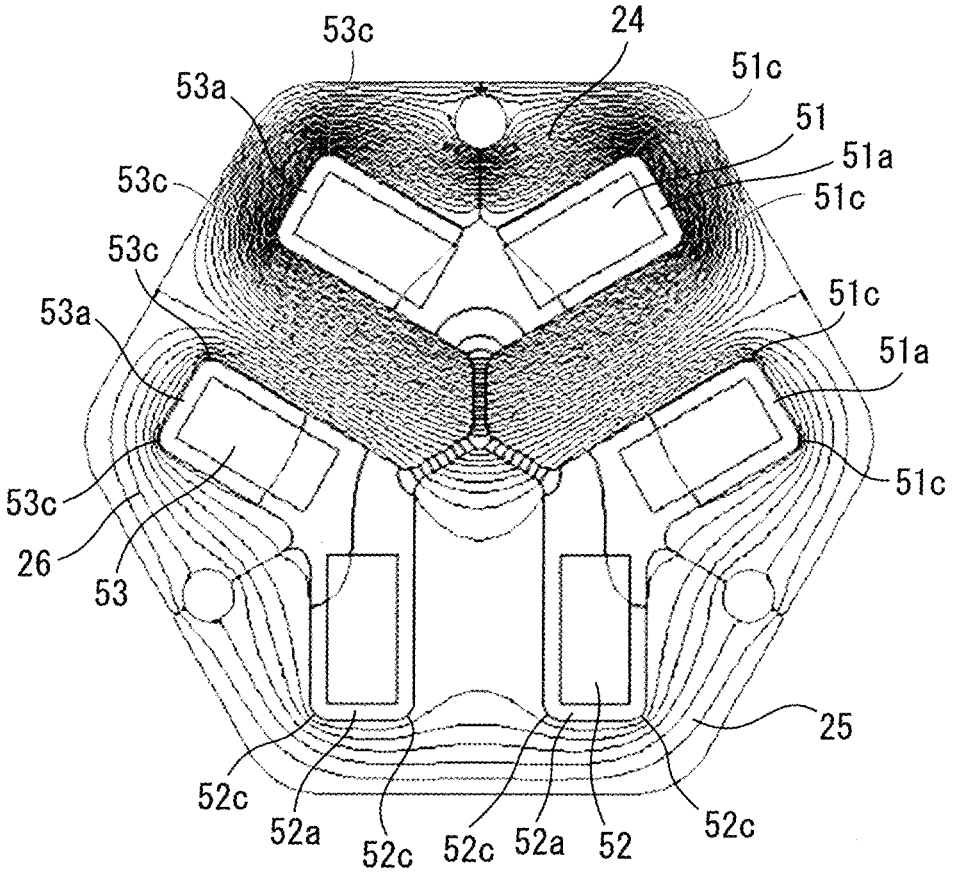
FIG. 1C is a view showing the magnetic flux density of the reactor shown in FIG. 1B.

FIG. 1A is a perspective view of a reactor according to a first embodiment and FIG. 1B is a cross-sectional view of the reactor according to the first embodiment. As shown in FIG. 1A and FIG. 1B, a core body 5 of a reactor 6 includes an annular outer peripheral iron core 20 and at least three iron core coils 31 to 33 arranged inside the outer peripheral iron core 20 at equal intervals in the circumferential direction thereof. Furthermore, the number of the iron cores is preferably a multiple of there, whereby the reactor 6 can be used as a three-phase reactor. Note that, the outer peripheral iron core 20 may have another shape, such as a circular shape. The iron core coils 31 to 33 include iron cores 41 to 43 and coils 51 to 53 wound onto the iron cores 41 to 43, respectively.

The outer peripheral iron core 20 is composed of a plurality of, for example, three, outer peripheral iron core portions 24 to 26 divided in the circumferential direction. The outer peripheral iron core portions 24 to 26 are formed integrally with the iron cores 41 to 43, respectively. The outer peripheral iron core portions 24 to 26 and the iron cores 41 to 43 are formed by stacking a plurality of iron plates, carbon steel plates, or electromagnetic steel sheets, or are formed from a dust core. When the outer peripheral iron core 20 is formed from a plurality of outer peripheral iron core portions 24 to 26, even if the outer peripheral iron core 20 is large, such an outer peripheral iron core 20 can be easily manufactured. Note that the number of iron cores 41 to 43 and the number of iron core portions 24 to 26 need not necessarily be the same.

As can be understood from FIG. 1B, the iron cores 41 to 43 are approximately of the same size and are arranged at approximately equal intervals in the circumferential direction of the outer peripheral iron core 20. In FIG. 1B, the radially outer ends of the iron cores 41 to 43 are coupled to the iron core portions 24 to 26, respectively.

Further, the radially inner ends of the iron cores 41 to 43 converge toward the center of the outer peripheral iron core 20, and the tip angles thereof are approximately 120 degrees. The radially inner ends of the iron cores 41 to 43 are separated from each other via gaps 101 to 103, through which magnetic connection can be established.

In other words, in the first embodiment, the radially inner end of the iron core 41 is separated from the radially inner ends of the two adjacent iron cores 42 and 43 via gaps 101 and 103. The same is true for the other iron cores 42 and 43. It is ideal that the sizes of the gaps 101 to 103 be equal to each other, but they may not be equal. As can be understood from FIG. 1B, the point of intersection of the gaps 101 to 103 is located at the center of the reactor 6. The core body 5 is formed with rotational symmetry about this center.

In the first embodiment, the iron core coils 31 to 33 are arranged inside the outer peripheral iron core 20. In other words, the iron core coils 31 to 33 are surrounded by the outer peripheral iron core 20. Thus, leakage of magnetic flux from the coils 51 to 53 to the outside of the outer peripheral iron core 20 can be reduced.

Referring again to FIG. 1B, the coils 51 to 53 are arranged in coil spaces 51*a* to 53*a* formed between the outer peripheral iron core portions 24 to 26 and the iron cores 41 to 43. In the coil spaces 51*a* to 53*a*, the inner peripheral surfaces and the outer peripheral surfaces of the coils 51 to 53 are adjacent to the inner walls of the coil spaces 51*a* to 53*a*.

The coil spaces 51*a* to 53*a* each include four corner parts 51*c* to 53*c* in the cross-section of the reactor 6 in the axial direction. In the first embodiment, at least one of the respective corner parts 51*c* to 53*c* is rounded. In FIG. 1B, all of the respective corner parts 51*c* to 53*c* are rounded. In the first embodiment, the radius of the rounded corner part may be a value between half of the length L of the gaps 101 to 103 and half of the width W of the coil space 51*a*. When the length L of the gaps 101 to 103 is larger than the width W of the coil space 51*a*, the radius of the rounded corner part may be a value less than or equal to half of the width W of the coil space 51*a*.

Figure 2A:
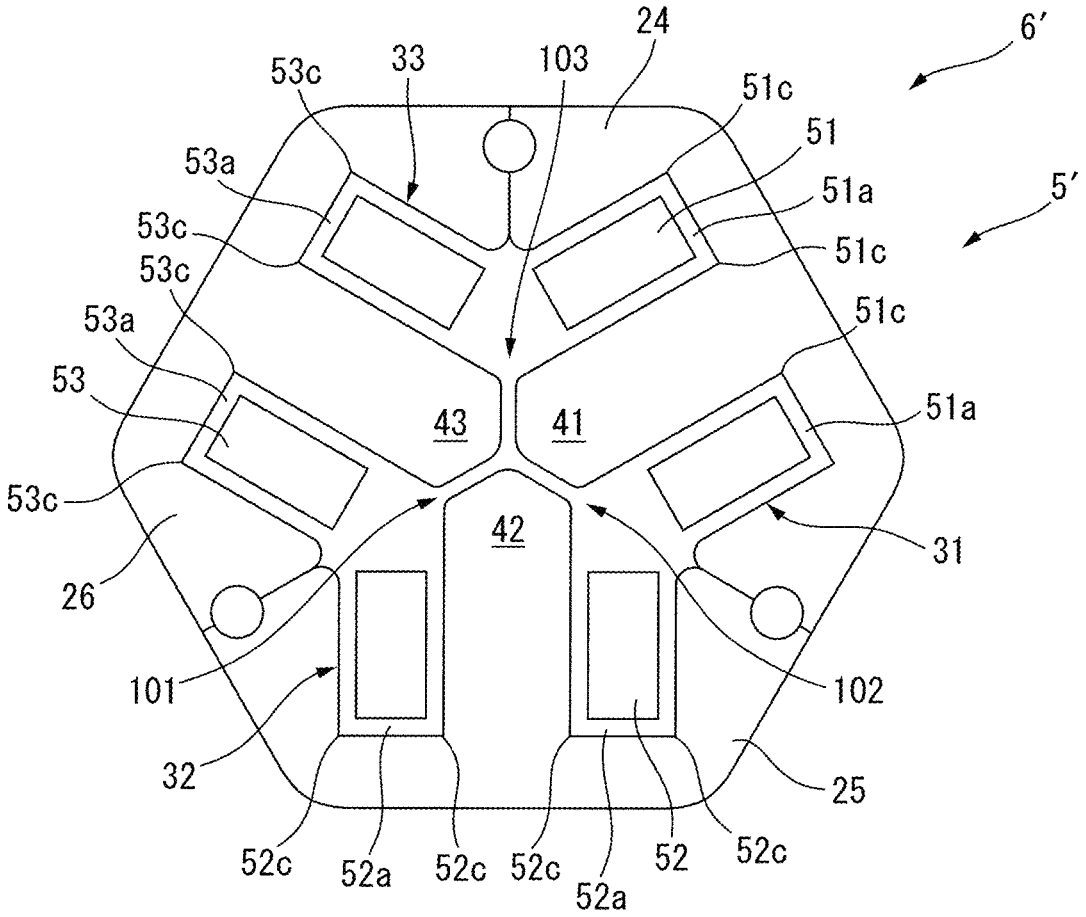
FIG. 2A is a cross-sectional view of a reactor according to the prior art.

FIG. 2A is a cross-sectional view of a reactor according to the prior art. The configuration of the reactor 6' according to the prior art is substantially the same as the configuration of the reactor 6 according to the first embodiment. However, the reactor 6' differs from the reactor 6 in that the corner parts 51*c* to 53*c* of the coil spaces 51*a* to 53*a* of the reactor 6' form right angles in the cross-section of the reactor 6'.

Figure 1D:
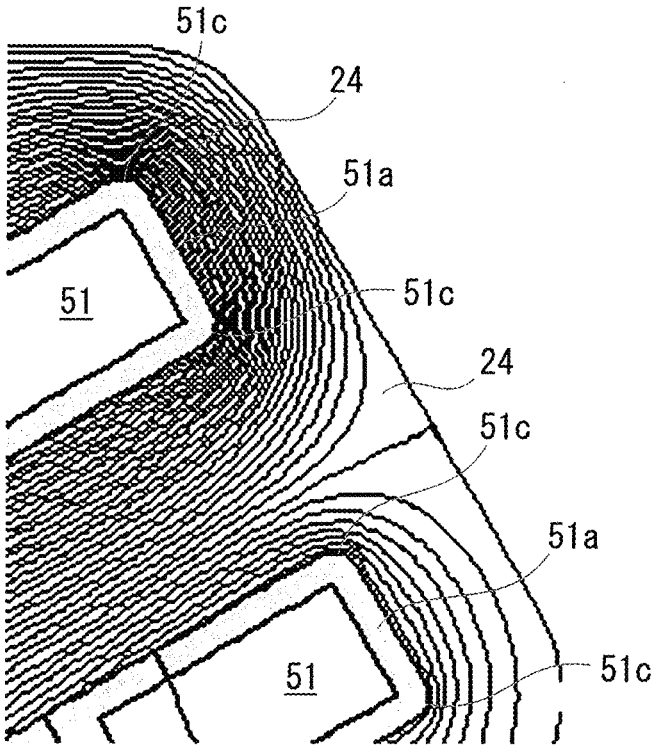
FIG. 1D is an enlarged partial view of FIG. 1C.
Figure 2B:
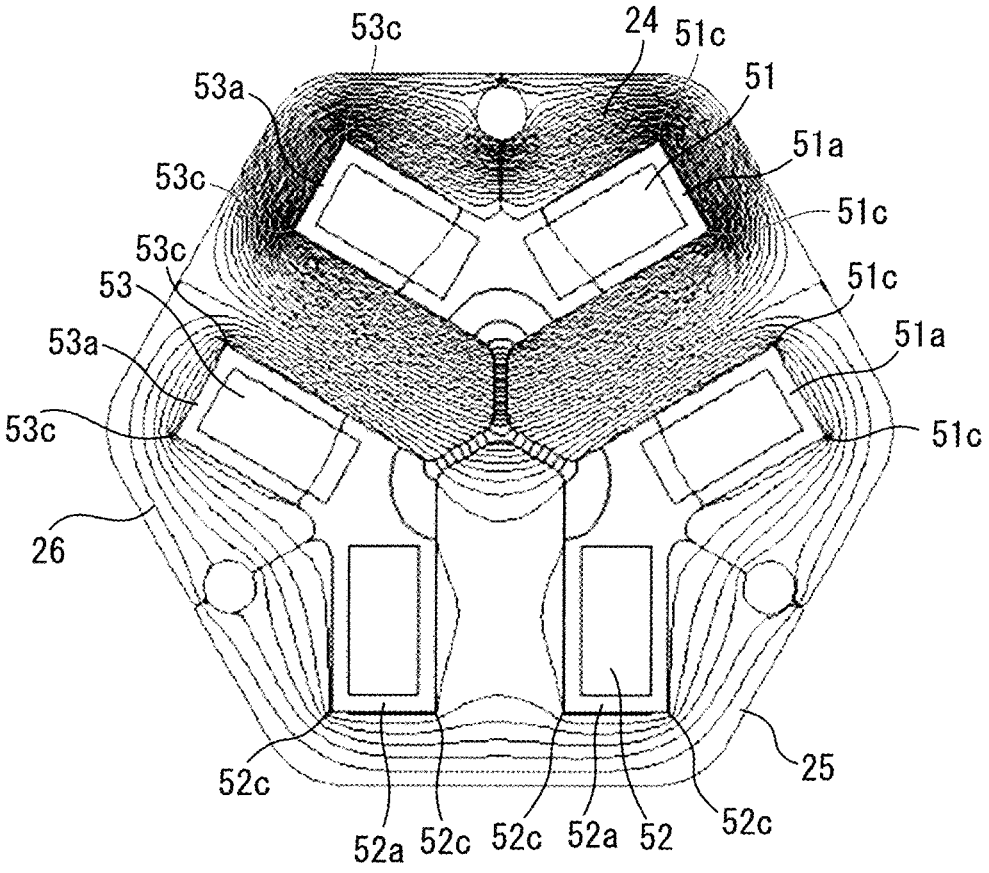
FIG. 2B is a view showing the magnetic flux density of the reactor according to the prior art.
Figure 2C:
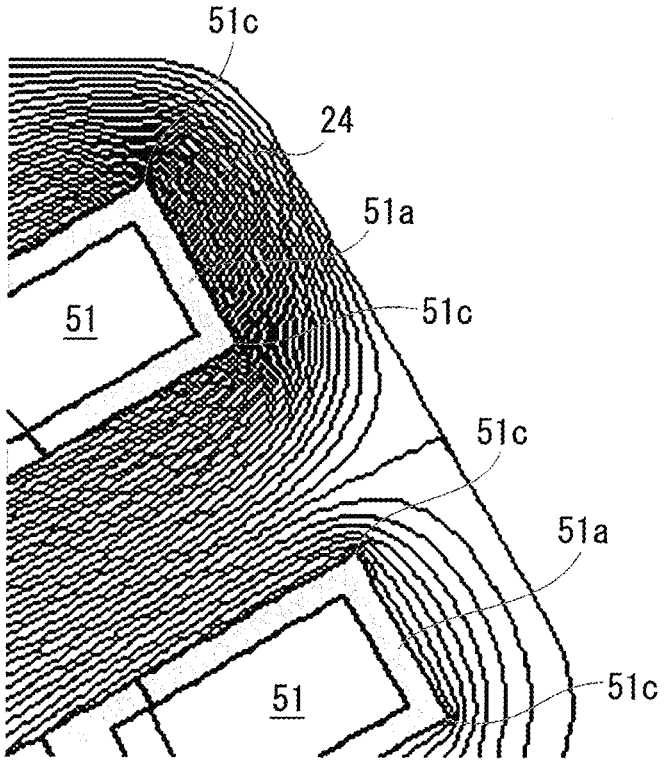
FIG. 2C is an enlarged partial view of FIG. 2B.

FIG. 10 and FIG. 2B are views showing the magnetic flux densities of the reactors according to the first embodiment and the prior art, respectively. Further, FIG. 1D and FIG. 2C are enlarged partial views of FIG. 10 and FIG. 2B, respectively. For the ease of understanding, in these drawings and the other similar drawings that are described later, the reference numerals of some members are omitted.

In FIG. 2B and FIG. 2C, the magnetic flux flowing in the vicinity of the corner parts Sic of the coil space 51*a* is relatively dense. In contrast thereto, in FIG. 10 and FIG. 1D, the magnetic flux flowing in the vicinity of the corner part 51*c* of the coil spaces 51*a* is relatively sparse. In the first embodiment, the corner parts 51*c* of the coil space 51*a* are rounded to a radius of 1 mm, whereby the concentration of magnetic flux in the corner parts 51*c* is alleviated. The same is true for the other corner parts 52*c*, 53*c*.

Thus, in the first embodiment, iron loss can be reduced and magnetic flux saturation can be suppressed. Further, it can be understood that the effect of a reduction in iron loss can be further enhanced when a high frequency current flows.

Figure 3A:
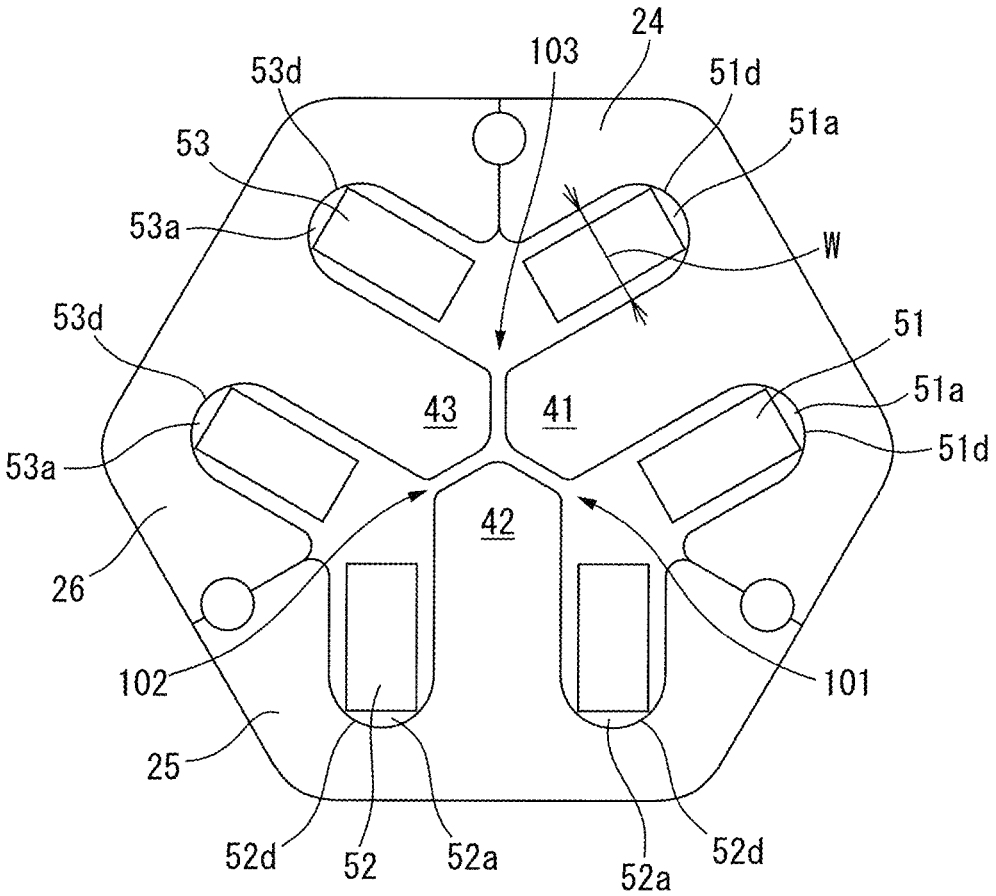
FIG. 3A is a cross-sectional view of a reactor according to a second embodiment.

Further, FIG. 3A is a cross-sectional view of a reactor according to a second embodiment. In the second embodiment, respective rounded corner parts 51*d* to 53*d* are formed in the outer ends of the coil spaces 51*a* to 53*a* in the cross-section of the reactor 6 in the axial direction. The cross-section of one corner part 51*d* shown in FIG. 3A is semicircular and one corner part 51*d* corresponds to two rounded corner parts 51*c* shown in FIG. 1B. In the second embodiment, the radius of the rounded corner parts 51*d* to 53*d* is approximately equal to half of the width W of the coil spaces 51*a*.

Figure 3B:
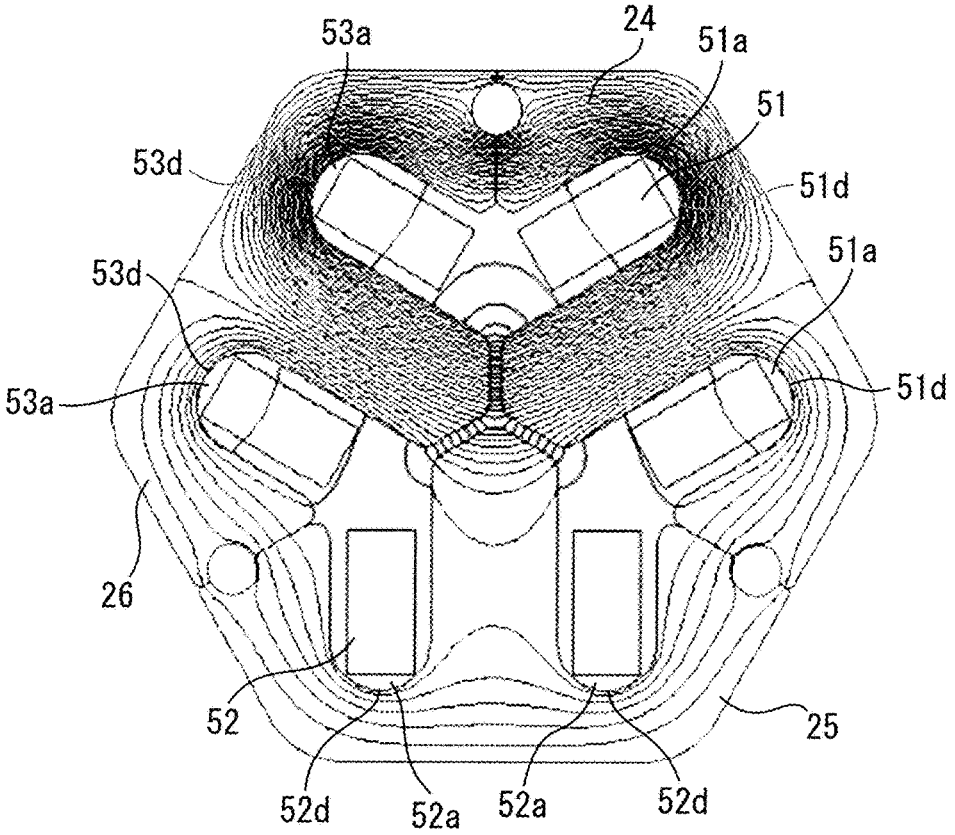
FIG. 3B is a view showing the magnetic flux density of the reactor shown in FIG. 3A.
Figure 3C:
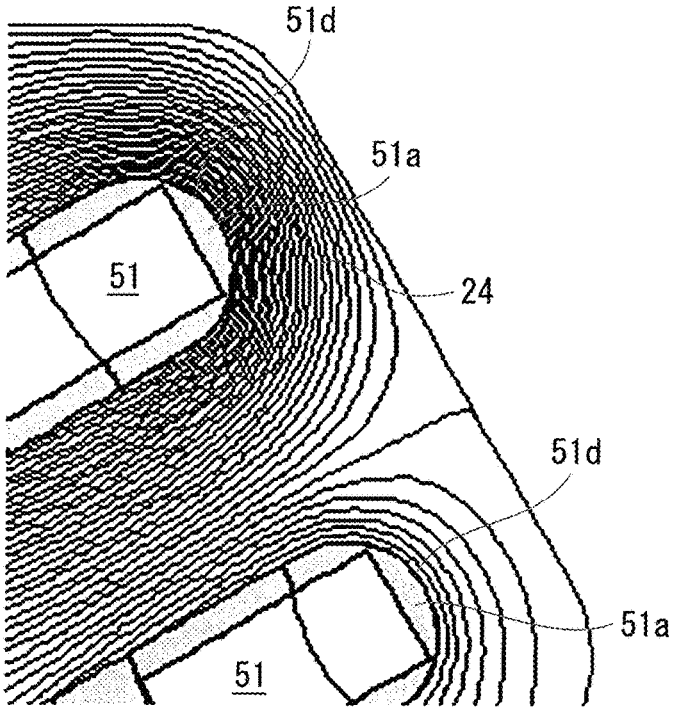
FIG. 3C is an enlarged partial view of FIG. 3B.

FIG. 3B is a view showing the magnetic flux density of the reactor shown in FIG. 3A and FIG. 3C is an enlarged partial view of FIG. 3B. When these drawings are compared with the drawings showing the magnetic flux densities described above, in the configurations shown in FIG. 3B and FIG. 3C, it can be understood that the concentration of magnetic flux can be alleviated the most. Furthermore, iron loss generally increases as frequency increases. Thus, the configuration of the second embodiment is particularly advantageous in the case of reactors used for high frequencies.

Figure 4:
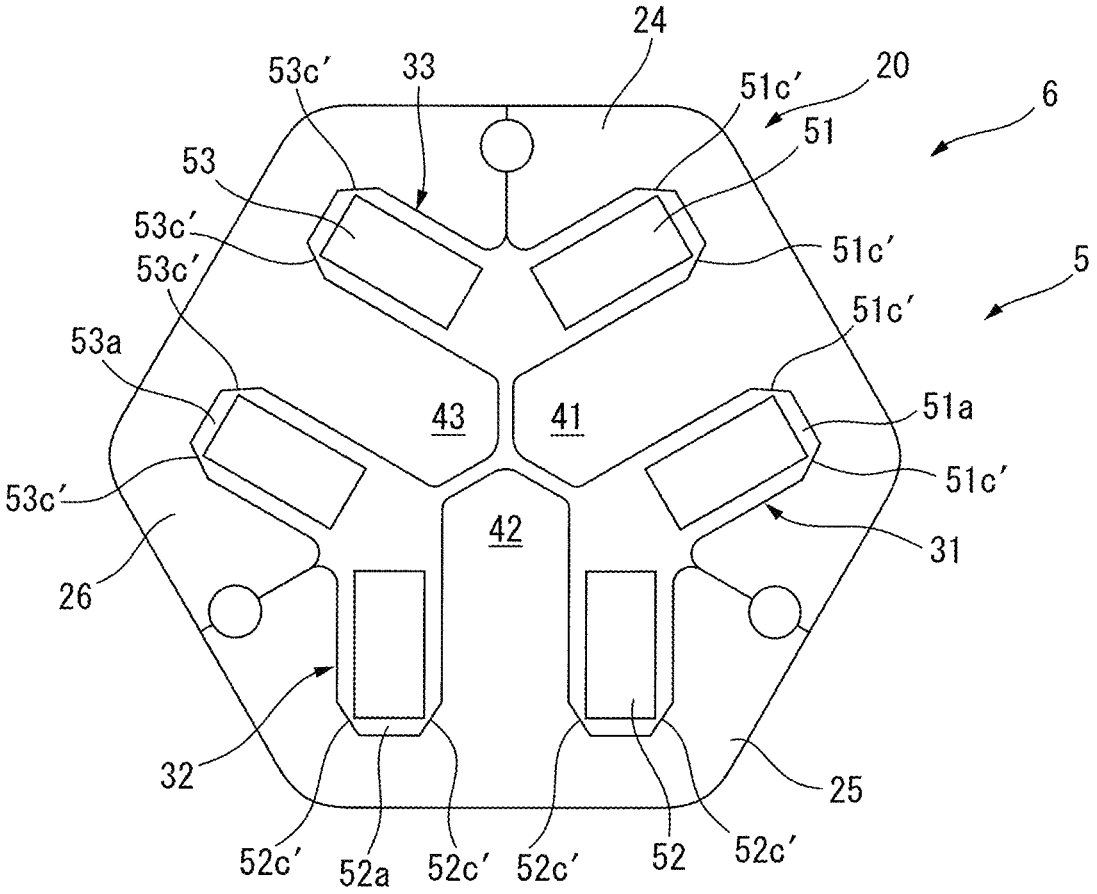
FIG. 4 is a cross-sectional view of a reactor according to a third embodiment.

FIG. 4 is a cross-sectional view of a reactor according to a third embodiment. The corner parts 51*c*' to 53*c*' shown in FIG. 4 are part of a hexagon. More specifically, two corner parts 51*c*' of the coil space 51*a* and the side therebetween correspond to one side of a hexagon and portions defining the internal angles at both ends of the one side. Alternatively, the corner parts 51*c*' to 53*c*' may be portions of a polygon whose internal angle is an obtuse angle of 100° or greater.

In such a configuration, the magnetic flux densities are substantially the same as those in the reactor having the corner parts 51*c* to 53*c* which are rounded so as to substantially form part of a polygon. Therefore, it can be understood that the same effects as described above can be obtained. Furthermore, in the third embodiment, the corner parts 51*c*' to 53*c*' can be easily made as compared with the formation of rounded corner parts. Furthermore, the corner parts 51*c*' to 53*c*' corresponding to a part of a polygon may be subjected to the aforementioned rounding.

Figure 5:
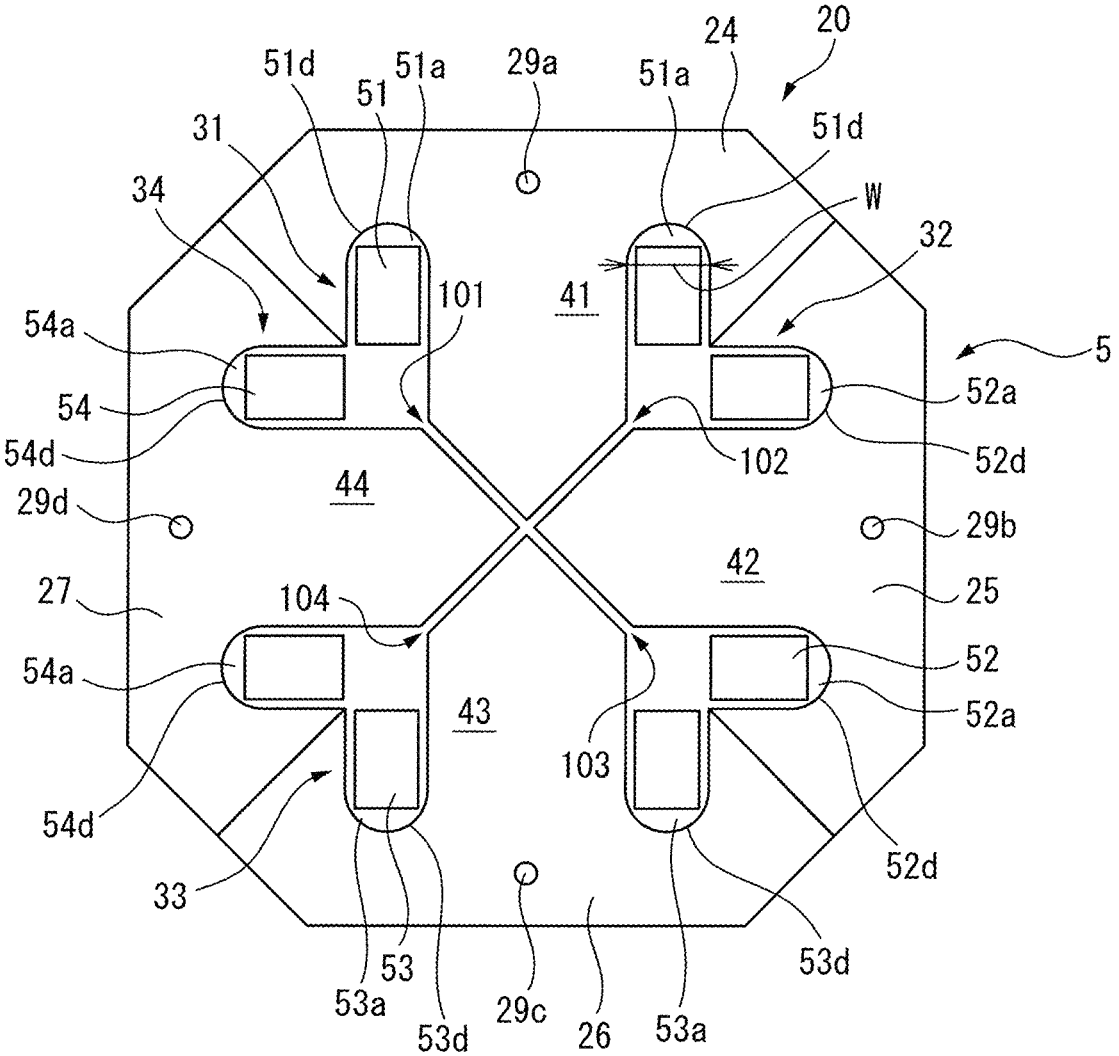
FIG. 5 is a cross-sectional view of a reactor according to a fourth embodiment.

Further, FIG. 5 is a cross-sectional view of a reactor according to a fourth embodiment. The core body 5 shown in FIG. 5 includes a substantially octagonal outer peripheral iron core 20 and four iron core coils 31 to 34, which are the same as the aforementioned iron core coils, arranged inside the outer peripheral iron core 20. These iron core coils 31 to 34 are arranged at substantially equal intervals in the circumferential direction of the reactor 6. Furthermore, the number of the iron cores is preferably an even number of 4 or more, so that the reactor 6 can be used as a single-phase reactor.

As can be understood from the drawing, the outer peripheral iron core 20 is composed of four outer peripheral iron core portions 24 to 27 divided in the circumferential direction. The iron core coils 31 to 34 include iron cores 41 to 44 extending in the radial directions and coils 51 to 54 wound onto the iron cores, respectively. The radially outer ends of the iron cores 41 to 44 are integrally formed with the respective outer peripheral iron core portions 24 to 26. Note that the number of the iron cores 41 to 44 need not necessarily be the same as the number of the outer peripheral iron core portions 24 to 27. The same is true for the core body shown in FIG. 1A.

Further, each of the radially inner ends of the iron cores 41 to 44 is located near the center of the outer peripheral iron core 20. In FIG. 5, the radially inner ends of the iron cores 41 to 44 converge toward the center of the outer peripheral iron core 20, and the tip angles thereof are about 90 degrees. The radially inner ends of the iron cores 41 to 44 are separated from each other via the gaps 101 to 104, which can be magnetically coupled.

Rounded corner parts 51*d* to 54*d* are arranged in the outer ends of the coil spaces 51*a* to 54*a* shown in FIG. 5, respectively. The corner parts 51*d* to 54*d* have the same shapes as the corner parts 51*d* to 53*d* described above. Namely, the radius of the rounded corner parts 51*d* to 54*d* of the fourth embodiment is approximately equal to half of the width W of the coil space 51*a*. Thus, in this case as well, it is clear that the same effects as described above can be obtained. Note that appropriate combinations of some of the embodiments described above are within the scope of the present disclosure.

ASPECTS OF THE PRESENT DISCLOSURE

According to the first aspect, there is provided a reactor (6), comprising an outer peripheral iron core (20), and at least three iron core coils (31 to 34) arranged inside the outer peripheral iron core, wherein the at least three iron core coils are composed of iron cores (41 to 44) and coils (51 to 54) wound onto the iron cores, respectively, gaps (101 to 104), which can be magnetically coupled, are formed between one of the at least three iron cores and another iron core adjacent thereto, the coils are arranged in coil spaces (51*a* to 54*a*) formed between the iron cores and the outer peripheral iron core, and at least one corner part (51*c* to 53*c*) in the cross-section of the coil spaces in the axial direction is rounded, or the at least one corner part (51*c*' to 53*c*') is one part of a polygon having an internal obtuse angle of not less than 100°.

According to the second aspect, in the first aspect, when the lengths of the gaps are not smaller than the widths of the coil spaces, the radius of the rounded corner part is not greater half of the width of the coil spaces, and when the lengths of the gaps are smaller than the widths of the coil spaces, the radius of the rounded corner part is greater than half of the lengths of the gaps and less than half the widths of the coil spaces.

According to the third aspect, in the first or second aspect, the number of the at least three iron core coils is a multiple of 3.

According to the fourth aspect, in the first or second aspect, the number of the at least three iron core coils is an even number not less than 4.

EFFECTS OF THE ASPECTS

In the first aspect, since the corner parts of the coil spaces are rounded or the corner parts form part of a polygon having an internal obtuse angle, the concentration of magnetic flux at the corner parts can be mitigated, and as a result, iron loss can be reduced and the likelihood of magnetic flux saturation is reduced.

In the second aspect, the concentration of magnetic flux can be mitigated with a relatively simple structure. Further, the corner parts of the coil spaces of existing rectors can be easily rounded.

In the third aspect, the reactor can be used as a three-phase reactor.

In the fourth aspect, the reactor can be used as a single-phase reactor.

Though the present invention has been described using representative embodiments, a person skilled in the art would understand that the foregoing modifications and various other modifications, omissions, and additions can be made without departing from the scope of the present invention.

The invention claimed is:

1. A reactor, comprising an outer peripheral iron core, and at least three iron core coils arranged inside the outer peripheral iron core, wherein the at least three iron core coils are composed of iron cores and coils wound onto the iron cores, respectively, gaps, which can be magnetically coupled, are formed between one of the at least three iron cores and another iron core adjacent thereto, the coils are arranged in coil spaces formed between the iron cores and the outer peripheral iron core, one portion of the coil space is parallel with an inner circumferential surface of the coil and another portion of the coil space is parallel with an outer circumferential surface of the coil, and two corner parts located at the outer peripheral iron core side in the cross-section of the coil spaces in the axial direction is rounded, or the two corner parts is one part of a polygon having an internal obtuse angle of not less than 100°.

2. The reactor according to claim 1, wherein when the lengths of the gaps are not smaller than the widths of the coil spaces, the radius of the rounded corner part is not greater half of the width of the coil spaces, and when the lengths of the gaps are smaller than the widths of the coil spaces, the radius of the rounded corner part is greater than half of the lengths of the gaps and less than half the widths of the coil spaces.

3. The reactor according to claim 1, wherein the number of the at least three iron core coils is a multiple of 3.

4. The reactor according to claim 1, wherein the number of the at least three iron core coils is an even number not less than 4.

5. The reactor according to claim 1, wherein clearance is formed between the inner circumferential surface of the coil and the one of the at least three iron cores.

* * * * *